United States Patent [19]

Schoeps

[11] Patent Number: 4,884,995

[45] Date of Patent: Dec. 5, 1989

[54] HYDRAULIC TORQUE IMPULSE GENERATOR

[75] Inventor: Knut C. Schoeps, Tyresö, Sweden

[73] Assignee: Atlas Copco Aktiebolag, Nacka, Sweden

[21] Appl. No.: 190,261

[22] Filed: May 2, 1988

[30] Foreign Application Priority Data

May 8, 1987 [SE] Sweden ..... 8701912-1

[51] Int. Cl.[4] ..... B25B 21/02; B25D 15/00

[52] U.S. Cl. ..... 464/25

[58] Field of Search ..... 81/463, 464, 465, 466; 173/93, 93.5; 464/25

[56] References Cited

U.S. PATENT DOCUMENTS

| | | | |
|---|---|---|---|
| 3,263,449 | 8/1966 | Kramer | 464/25 |
| 4,553,948 | 11/1985 | Tatsuno | 464/25 |
| 4,766,787 | 8/1988 | Sugimoto et al. | 464/25 X |
| 4,785,693 | 11/1988 | Minamiyama et al. | 464/25 X |

FOREIGN PATENT DOCUMENTS

| | | | |
|---|---|---|---|
| 243334 | 10/1987 | European Pat. Off. | 464/25 |

*Primary Examiner*—Daniel P. Stodola

*Attorney, Agent, or Firm*—Frishauf, Holtz, Goodman & Woodward

[57] ABSTRACT

A hydraulic torque impulse generator comprises a drive member (10) connected to a rotation motor and including a cylindrical fluid chamber (12) partly defined by a circumferential wall (14), and an output spindle (13) rotatably supported in coaxial relationship with the drive member (10) and having a rear portion (15) extending into the fluid chamber (12). The rear spindle portion (15) has two radial slots (18, 19) each supporting a radially movable seal element (21, 22) for sealing cooperation with seal lands (23, 24) on the fluid chamber wall (14). First seal ridges (25, 26) are provided on the rear spindle portion (15) for sealing cooperation with second seal ridges (28, 29) on the fluid chamber wall (14), thereby dividing the fluid chamber (12) into two high pressure compartments (H.P.) and two low pressure compartments (L.P.) during two short intervals of each revolution of the drive member (10) relative to the output spindle (13). A valve spindle (39) which is non-rotatively connected to the drive member (10) and rotatively supported in a coaxial bore (35) in the rear spindle portion (15) is provided with both a cam (40) for engaging the seal elements (21, 22) for urging the seal elements (21, 22) into contact with the fluid chamber wall (14), and passages (42, 43) formed therein for cooperation with passages (44, 45) in the rear spindle portion (15) for short circuiting the fluid chamber compartments (H.P. and L.P.) during every second one of the intervals.

6 Claims, 1 Drawing Sheet

HYDRAULIC TORQUE IMPULSE GENERATOR

BACKGROUND OF THE INVENTION

This invention relates to a hydraulic torque impulse generator primarily intended for a screw joint tightening power tool. In particular the invention concerns a hydraulic torque impulse generator, comprising a drive member connected to a rotation motor and including a cylindrical fluid chamber partly defined by a circumferential wall, an output spindle rotatably supported in coaxial relationship with said drive member and having a rear portion extending into said fluid chamber, said rear spindle portion having two radial slots each supporting a radially movable seal element for sealing cooperation with seal lands on the fluid chamber wall, and first seal ridges on said rear spindle portion for sealing cooperation with second seal ridges on said fluid chamber wall, thereby dividing said fluid chamber into two high pressure compartments and two low pressure compartments during short intervals of the relative rotation between said drive member and said output spindle.

The object of the invention is to accomplish a compact torque impulse generator of the above type in which there is generated just one torque impulse during each full revolution of the drive member relative to the output spindle, and in which the frictional wear of the seal elements is brought down to a minimum.

DETAILED DESCRIPTION

Figure 1:
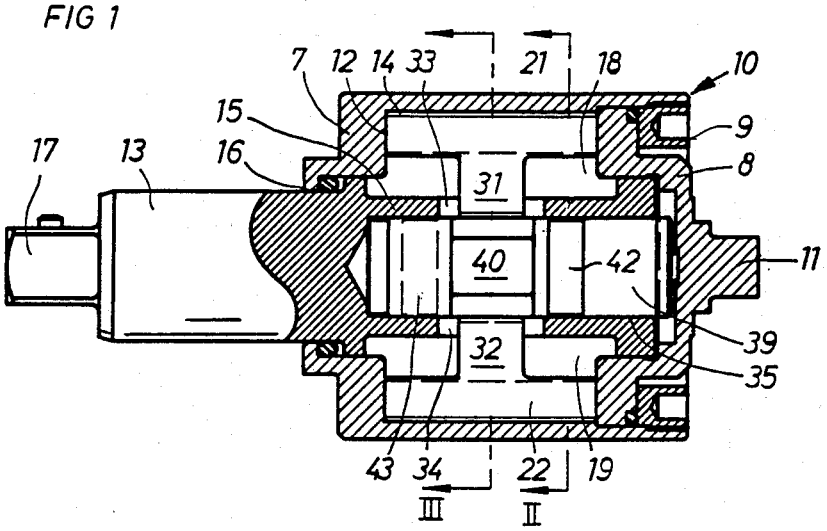
FIG. 1 shows a longitudinal section through an impulse generator according to the invention.
Figure 2:
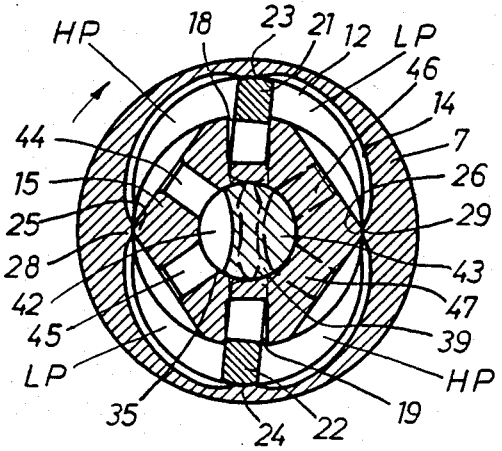
FIG. 2 shows a cross section along line II—II in FIG. 1.
Figure 3:
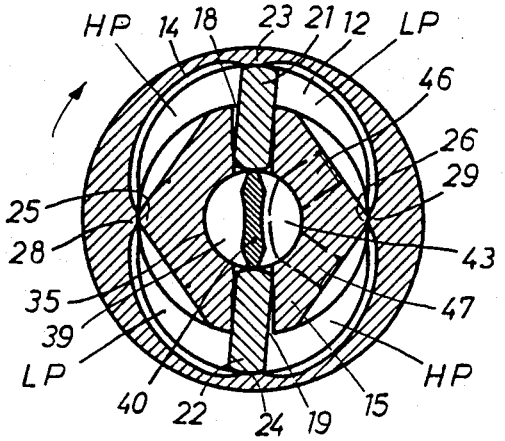
FIG. 3 shows a cross section along line III—III in FIG. 1.

The hydraulic torque impulse generator shown in FIGS. 1–3 comprises a drive member 10 which includes a cup-shaped main body 7 and a rear end closure 8 secured to the main body 7 by means of a ring nut 9. The end closure 8 is formed with a rearwardly extending stub axle 11 for connection of the drive member 10 to a rotation motor.

The drive member 10 includes a cylindrical fluid chamber 12 which is partly defined by a circumferential wall 14. An output spindle 13 coaxially journalled relative to the drive member 10 comprises a rear portion 15 that extends into the fluid chamber 12 through a front opening 16 in the latter. At its forward end the output spindle 13 has a square end portion 17 for connection to a nut socket.

The rear spindle portion 15 is formed with two oppositely directed radial slots 18, 19 in which radially movable vanes 21, 22 are supported. The vanes 21, 22 are arranged to cooperate sealingly with two oppositely located seal lands 23, 24 on the fluid chamber wall 14. These lands 23, 24 extend in parallel with the rotation axis of the drive member 10.

The rear portion 15 of the output spindle 13 is formed with a first set of two diametrically opposite seal ridges 25, 26 which are arranged to cooperate sealingly with a second set of two diametrically opposite seal ridges 28, 29 formed on the fluid chamber wall 14. The first set of seal ridges 25, 26 as well as the second set of seal ridges 28, 29 extend in parallel with the rotation axis which is common to the drive member 10 and the output spindle 13.

The above described vanes 21, 22, seal lands 23, 24, first set of ridges 25, 26 and second set of ridges 28, 29 are arranged to cooperate twice every full relative revolution between the drive member 10 and the output spindle 13, thereby dividing the fluid chamber 12 into two high pressure compartments H.P. and two low pressure compartments L.P.

The vanes 21, 22 are T-shaped and extend with their central portions 31, 32 through openings 33, 34 in spindle portion 15. The latter is provided with a central coaxial bore 35 into which the openings 33, 34 open.

A valve spindle 39 is rotatively supported in the bore 35 and is non-rotatively connected at its rear end to the drive member 10. The coupling means connecting the valve spindle 39 to the drive member 10 is preferably designed to allow a certain degree of radial freedom so as to absorb occuring radial misalignments between the rotation axes of the valve spindle 39 and the drive member 10. The connection of the spindle 39 per se does not form a part of the invention and therefore, it is not described in detail.

Moreover, the valve spindle 39 is formed with a cam portion 40, which is arranged to engage the vane portions 31, 32 and to urge positively the vanes 21, 22 toward the fluid chamber wall 14.

The valve spindle 39 also comprises two passage forming grooves 42, 43 which are located on each side of the cam portion 40 and face diametrically opposite directions. Once every full relative revolution between the drive member 10 and the output spindle 13 these grooves 42, 43 are arranged to form bypass communications together with radial passages 44, 45 and 46, 47, respectively, in the rear spindle portion 15. The latters extend between the bore 35 and the fluid chamber 12, and open into the latter on each side of the first set of seal ridges 25, 26. The passages 44, 45 form a pair and are located in front of the cam portion 40, whereas the other passages 46, 47 form another pair located behind the cam portion 40.

In operation, rotational power is applied on the drive member 10 via stub axle 11, whereas the output spindle 13 is connected to a screw joint to be tightened. Due to the torque resistance which is developed in the screw joint and transferred to the output spindle 13, a relative rotation between the drive member 10 and the latter occurs. The vanes 21,22 are kept in continuous contact with the fluid chamber wall 14 by the action of the cam portion 40, and once every half revolution of the drive member 10 relative to the output spindle 13 the vanes 21, 22 interact sealingly with the lands 23, 24 and the ridges 25, 26 interact sealingly with the fluid chamber ridges 28, 29. Thereby, the fluid chamber 12 is divided into two high pressure compartments H.P. and two low pressure compartments L.P. The difference in pressure between the high pressure compartments and the low pressure compartments generates a torque impulse in the output spindle 13.

Due to the interaction of the passages 44-47 and the passage forming grooves 42, 43 on the valve spindle 39, however, a shortcircuiting communication is established between the high and low pressure compartments in one of the two sealing positions each revolution of the drive member 10. This bypass condition is illustrated in FIGS. 2 and 3. This means that one torque impulse only is generated during each full revolution of the drive member 10 relative to the output spindle 13, and that, due to a long acceleration distance of the drive member 10, a powerful torque impulse is generated.

I claim:

1. Hydraulic torque impulse generator, comprising:

a drive member (10) connected to a rotation motor and including a cylindrical fluid chamber (12) partly defined by a circumferential fluid chamber wall (14), said fluid chamber wall (14) having seal lands (23, 24) thereon;

an output spindle (13) rotatably supported in coaxial relationship with said drive member (10) and being rotatable relative to said drive member (10), said output spindle having a rear spindle portion (15) extending into said fluid chamber (12), said rear spindle portion (15) having two radial slots (18, 19) therein;

a radially movable seal element (21, 22) supported in each of said radial slots, respectively, for sealing cooperation with said seal lands (23, 24) on said fluid chamber wall (14);

first seal ridges (25, 26) on said rear spindle portion (15);

second seal ridges (28, 29) on said fluid chamber wall (14) for sealing cooperation with said first seal ridges (25, 26);

said fluid chamber (12) being divided into two high pressure compartments (H.P.) and two low pressure compartments (L.P.) during short intervals of the relative rotation between said drive member (10) and said output spindle (13) at simultaneous cooperation between said seal elements (21, 22) and said seal lands (23, 24) and said first seal ridges (25, 26) and said second seal ridges (27, 28), respectively;

said rear spindle portion (15) comprising a coaxial bore (35) and at least two radial passages (44-47) coupling said coaxial bore (35) to said fluid chamber (12) on both sides of said first seal ridges (25, 26);

a valve spindle (39) non-rotatively connected to said drive member (10) and rotatively supported in said bore (35) and including passage forming means (42, 43) for controlling communication of said radial passages (44-47) with said coaxial bore (35);

said rear spindle portion (15) comprising openings (33, 34) through which at least a part (31, 32) of each seal element (21, 22) extends; and cam means (40), associated with said valve spindle (39) for engaging said part (31, 32) of each seal element (21, 22) and for positively urging said seal elements into contact with said fluid chamber wall (14).

2. The impulse generator of claim 1, wherein said cam means (40) is formed in one piece with said valve spindle (39).

3. The impulse generator of claim 1, wherein:

said radial passages (44-47) are four in number and are arranged in two pairs axially spaced from each other;

said passage forming means (42, 43) are two in number and are axially spaced along said valve spindle (39); and said cam means (40) is located between said two passage forming means (42, 43).

4. Th impulse generator of claim 3, wherein said cam means (40) is formed in one piece with said valve spindle (39).

5. The impulse generator of claim 3, wherein:

said openings (33, 34) in said rear spindle portion (15) are located between said pairs of radial passages (44-47); and said seal elements (21, 22) comprise T-shaped vanes having central portions (31, 32) extending through said openings (33, 34) for engagement with said cam means (40).

6. The impulse generator of claim 5, wherein said cam means (40) is formed in one piece with said valve spindle (39).

* * * * *